United States Patent [19]

Capamaggio

[11] Patent Number: 4,813,370

[45] Date of Patent: Mar. 21, 1989

[54] BOOKMARKER

[76] Inventor: Scott A. Capamaggio, 6377 Mill Pond Rd., Byron, N.Y. 14422

[21] Appl. No.: 184,369

[22] Filed: Apr. 21, 1988

[51] Int. Cl.[4] ..... B42D 9/00

[52] U.S. Cl. ..... 116/237; 24/67.11; 281/42

[58] Field of Search ..... 24/67.11; 116/234, 237–239; 281/42; D19/34

[56] References Cited

U.S. PATENT DOCUMENTS

| | | | |
|---|---|---|---|
| 840,475 | 1/1907 | Conter | 281/42 |
| 854,873 | 5/1907 | Conter | 281/42 |
| 1,150,678 | 8/1915 | Heazlewood | 281/42 |
| 1,438,299 | 12/1922 | Conter | 116/238 |
| 2,437,074 | 3/1948 | Chapin | 116/237 |
| 2,449,211 | 9/1948 | Forsyth | 116/237 |
| 3,158,131 | 11/1964 | Salayka | 116/237 |

FOREIGN PATENT DOCUMENTS

| | | | |
|---|---|---|---|
| 22904 | 5/1930 | Australia | 116/239 |
| 195756 | 4/1923 | United Kingdom | 116/237 |
| 1032569 | 6/1966 | United Kingdom | D19/34 |

*Primary Examiner*—William A. Cuchlinski, Jr.
*Assistant Examiner*—W. Morris Worth
*Attorney, Agent, or Firm*—Marjama & Pincelli

[57] ABSTRACT

An improved bookmarker for maintaining the place of a reader in a book having a spring retaining marking arm. A u-shaped clip has upwardly extending front and back sections and a bottom section having an axial slot on one edge and an opening spaced from the slot. The marking arm has a hook portion and a loop portion for engaging the opening and slot, respectively, of the bottom section fixedly securing the marking arm to the clip.

7 Claims, 5 Drawing Sheets

BOOKMARKER

BACKGROUND OF THE INVENTION

This invention relates to a bookmarker for maintaining the place of a reader in a book and also assisting the reader in holding the book.

In the prior art there exists metal bookmarkers which attach to the back of a book or a plurality of pages in the back of the book. These bookmarkers have a spring arm which maintains the place of the reader in the book while allowing easy turning of the pages. While these devices have been found to be useful, a problem has developed in that the spring arm can hang up or rub against a portion of the bookmarker. This can result in the spring slipping out of the page and/or reduce the life or effectiveness of the bookmarker. A further disadvantage of this device is that they are two part assemblies, which require a two part manufacturing process and manual assembly.

Applicant has invented an improved bookmarker which minimizes or overcomes the problems of the prior art.

SUMMARY OF THE INVENTION

In one aspect of the present invention, there is provided a bookmarker having a metal retaining spring. The retaining spring is designed such that it can freely move as the pages of the book are turned.

In another aspect of the present invention, there is provided a single piece plastic bookmarker which has a portion which clamps a portion of the book and a spring portion for maintaining the place of the book.

In yet another aspect of the present invention, there is provided a retaining spring which can be permanently affixed to the book.

DETAILED DESCRIPTION OF THE INVENTION

Figure 1:
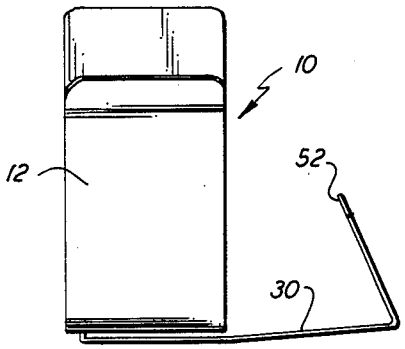
FIG. 1 is a front elevational view of a bookmarker made in accordance with the present invention.
Figure 3:
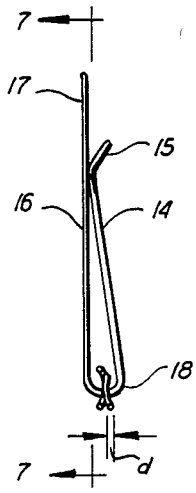
FIG. 3 is a side elevational view of FIG. 1.

Referring to FIGS. 1–8, there is illustrated a metal bookmarker 10 made in accordance with the present invention. Bookmarker 10 comprises a clip 12 having a general U-shaped configuration for clamping a portion of a book. Clip 12 comprises a front wall 14, a back wall 16 and a bottom section 18 connecting front wall 14 to back wall 16. Front and back walls 14, 16 each have an upper end 15, 17 respectively. The front and back walls 14, 16 are such that the upper ends 15, 16 extend toward each other so that a portion of the book will be clampingly held therebetween. Typically, the back cover or a plurality of pages toward the back of the book are held between walls 14 and 16. A sufficient number of pages are placed between the front and back walls 14, 16 so that the bookmarker will be firmly clamped in position to the book. Preferably, as illustrated, the upper end 15 has an outwardly curved portion 19 which assists in the insertion of a portion of the book or pages.

Figure 8:
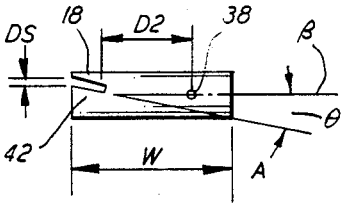
FIG. 8 is a bottom view of the bookmarker of FIG. 1 with the retaining spring removed.
Figure 8A:
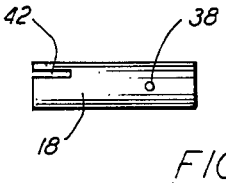
FIG. 8A is a bottom view of the bookmarker of FIG. 1 illustrating a modified configuration with the retaining spring removed.
Figure 9:
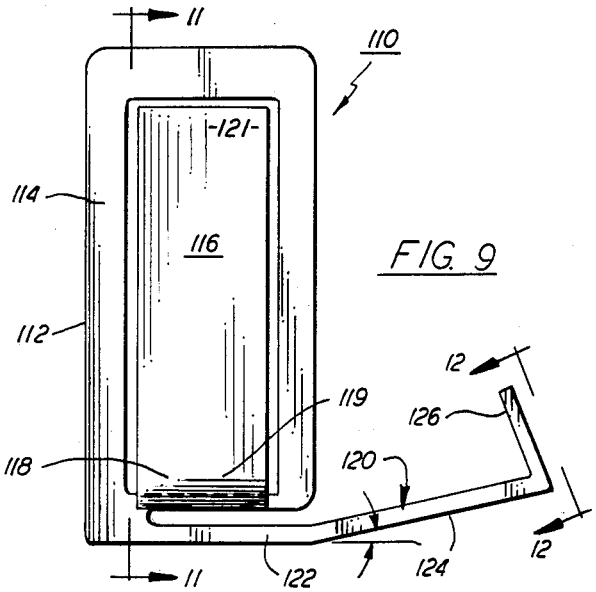
FIG. 9 is a front elevational view of a modified form of a bookmarker made in accordance with the present invention.
Figure 11:
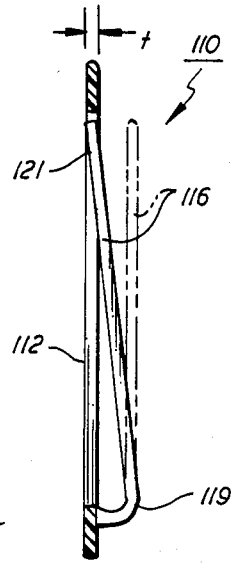
FIG. 11 is a cross-sectional view of the bookmarker of FIG. 9 as taken along line 11—11.
Figure 10:
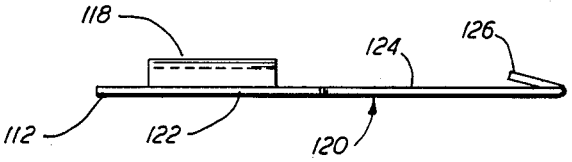
FIG. 10 is a bottom plan view of FIG. 9.
Figure 12:
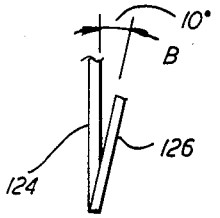
FIG. 12 is a partial view of the retaining arm as taken along line 12—12 of FIG. 9.

A retaining spring 30 is secured to the bottom section 18. Spring 30 is made of a single metal wire which is bent in the general shape as illustrated. Spring 30 has a mounting leg section 32 which is secured to the bottom section 18 of clip 12 and a marking leg section 34 for maintaining the place of a reader in the book upon which the clip 12 is secured. Spring 30 is made of a metal which allows flexability of the retaining spring 30 such that it will spring back into its preset configuration. In the particular embodiment illustrated, the retaining spring 30 is made out of stainless steel having a generally circular cross section with a diameter of about 0.031 inch. The mounting leg section 32 of spring 30 comprises a hook portion 36 at one end which passes through an opening 38 in the bottom section 18 and a loop retaining portion 40 which is configured to fit into slot 42 at one end of bottom section 18. The distance D between the hook section 36 and loop retaining portion 40 is such that when the hook 36 is passed through opening 38 and loop retaining portion 40 is placed in slot 42, a clamping force is applied therebetween so as to clampingly engage the bottom portion 18. Preferably the distance D is slightly less than the distance D2, the distance between opening 38 and slot 32. This results in the mounting section 32 having to be slightly deformed so that the hook and retaining portion 40 will snap into its respective opening 38 or slot 42. The slot 42 has a width DS equal to about twice the width d of the wire of spring 30 so that the inner section 41 and outer section can be side by side as illustrated. The slot 42 also preferably oriented along its longitudinal axis A so that the axis A form an angle with the longitude axis B of bottom section 13. The slot 42 is oriented so that the front end points toward the back of the book. This helps maintain the spring firmly against the book. Alternatively as illustrated in FIG. 8A, the slot 32 may be shifted closer to the front of the bookmarker 10 so that the spring as opposed to the opening 38. Thus the spring 30 is biased toward the back of the book.

Figure 5:
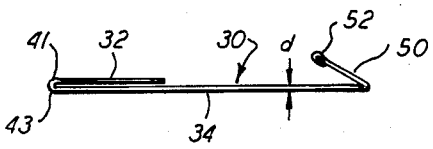
FIG. 5 is a top plan view of the retaining spring of FIG. 4.

The loop retaining section 40 comprises an inner section 41 and an outer section 43 which merges into marking leg 34. The loop retaining is configured such that the inner section 41 is disposed on the axial side closest toward the back of the book and the outer section 43 is disposed away from the back of the book toward the reader. Thus, the outer section 43 which merges into the marking leg 32 would be closer to the reader as illustrated in FIG. 5. This is in distinction to prior art devices wherein the marking leg portion has been disposed on the side of mounting leg section 32 closest to the back of the book. Applicants have found that it is desirable that the marking leg be disposed axially outwardly of the mounting leg 30 to allow freedom of movement. This avoids any unnecessary contact of the marking leg 32 against mounting leg 30 which can result from the movement of the marking leg 32 during turning of the page.

Figure 6:
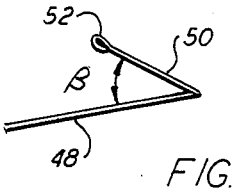
FIG. 6 is end view of the retaining spring as taken along line 6—6 of FIG. 4.
Figure 7:
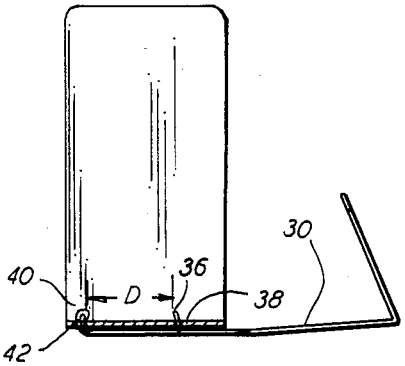
FIG. 7 is a cross-sectional view of the bookmarker as taken along lines 7—7 of FIG. 3.

The marking leg 34 comprises a first horizontal section 46 of length L1 which extends from inner section 43 across the width W of clip 12, an intermediate section 48 which extends from the outer end of the first horizontal leg 46 and a third vertically extending section 50 at the other end of intermediate section 48. The intermediate section 50 extends in a substantially horizontal direction, however, as illustrated, it is preferably disposed at a small angle $\alpha$ and has a length L2. Preferably the angle $\alpha$ (alpha) extends from 0° to 20°. In the particular embodiment illustrated, the angle alpha is equal to about 3 o The third vertical extending section 50 extends back toward the clip 12 and has a length of L3. The leg 50 terminates at a terminal end 52 which is preferably disposed a distance D3 above the bottom of the page of the book being read. Preferably, as illustrated, the terminal end is formed by turning back the end of the wire to form a loop. This minimizes the chance of tearing the page. However, the terminal end 52 may take a variety of other shapes, for example, but not by way of limitation, the terminal end may be spherical in shape. The length L3, of vertical leg section and the length L2 of intermediate leg 48 is such that the terminal end 52 is disposed a distance of at least $\frac{3}{8}$ inch from the bottom of the page and preferably, at least $\frac{1}{2}$ inch but no greater than about one inch. If the terminal end 52 extends a distance too high up into the book, this increases the possibility that the page, when turned, will catch on third leg 50. In the particular embodiment illustrated, the terminal end 52 is disposed a distance D3 of about $\frac{3}{4}$ of an inch from the bottom of the page. In the preferred form of the present invention, the intermediate section is disposed at a small angle $\alpha$ such that the juncture 57 of the intermediate leg 48 and third leg 50 rest on the page. The third leg 50 is preferably disposed at an angle $\beta$ such that the third leg 50 is directed back toward the back of the book as illustrated in FIG. 6. Directing leg 50 in this manner helps to maintain a constant force against the pages on the page as pages are turned.

In order to more fully understand the present invention, a detailed discussion will be made with regard as to how the bookmarker of the present invention is used by a reader.

Figure 2:
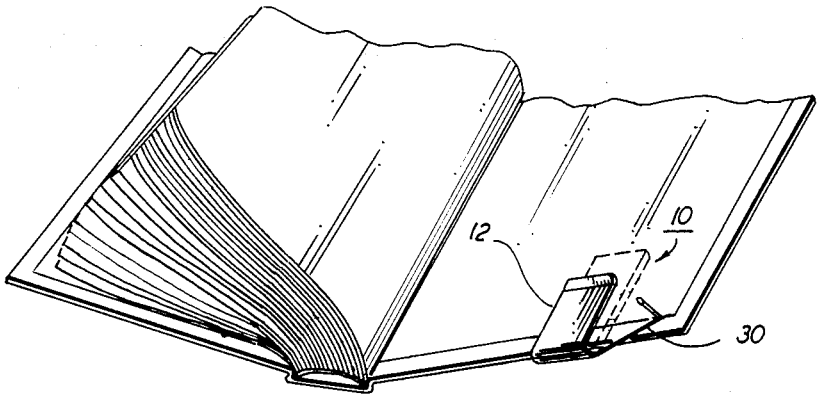
FIG. 2 is a perspective view of a bookmarker of FIG. 1 as mounted to a book.
Figure 2A:
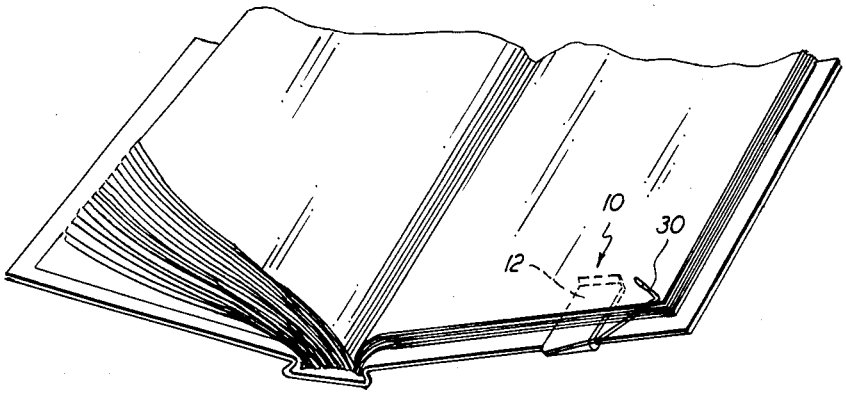
FIG. 2A is perspective view similar to FIG. 2 illustrating the use of the bookmarker.
Figure 4:
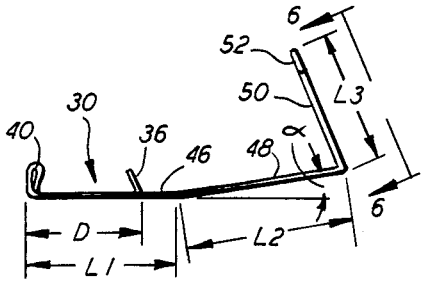
FIG. 4 is a front elevational view of the retaining spring of the bookmarker of FIG. 1.
Figure 4A:
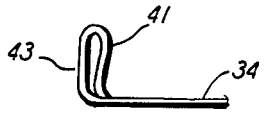

A reader first opens up the book as illustrated in FIG. 2. The clip 12 is attached to a portion of the book, preferably on the bottom right hand side, i.e., toward the back of the book. The clip 12 may clamp the back cover, if the book is out of the hard type variety, and/or plurality of pages in the back portion of the book. The retaining spring 30 is placed against the page as illustrated in FIG. 4. The retaining spring 30 will press up against the page. The spring 30 is designed so as to provide sufficient amount of force to maintain the page in position and prevent it from turning of its own volition. The spring 30 eliminates the need for the reader for maintaining the page on the back side of the book when reading the book. This helps free up one hand of the reader. When it is desirable to turn the page, the reader simply grabs the upper right hand corner of the page and turns it in the normal manner as one would turn any page. Since the bookmarker is in the lower right hand corner, the page simply slides out from underneath as illustrated in FIGS. 2A. As the page is turned over, the marking leg presses against the next page of the book, thus maintaining the position of the reader within the book and avoiding the need to hold the next page down as the page that has been just completed is turned to the left side. This procedure is simply repeated for each additional page. This prevents the reader from losing his place in the book. While in the embodiment illustrated, the bookmarker is placed in the lower right of the book, the bookmarker may be placed on the top side depending on the preference of the reader.

Referring to FIGS. 9 through 12, there is illustrated a modified form of the present invention. In this modified form, there is illustrated a bookmarker 110 made out of a molded plastic material. Bookmarker 110 may be made out of any plastic material desired. In the particular embodiment illustrated, the bookmarker 10 is made out of a polyurathane.

The bookmarker 110 has a clip portion 112 which has a base portion 114 and a retaining finger 116. In the particular embodiment illustrated, the retaining finger 116 fits within opening 118 in base section 114. The retaining finger 116 has a lower section 119 and an upper end 121. The retaining finger 116 is preferably designed such that the lower section 119 is axially outward of the base 114 and the upper end 121 extends back toward the base 114. The cross sectional thickness t of clip 112 and the selection of the material from which it is made is such that the finger 118 may be easily separated from the base 114 as illustrated in dash lines in FIG. 11 to allow a portion of the back of the book to be clamped therebetween.

Integrally formed with the base section 114 is a retaining arm 120 having a first horizontal section 122 which extends along the width W of the base 114, an intermediate section 124 which extends from the end of first horizontal section and a retaining vertical section 126. The intermediate section 124 is preferably disposed at an angle $\alpha$ in much the same manner as the intermediate section 48 of retaining marking leg 34 illustrated in FIG. 1. Likewise, the retaining vertical section 126 is disposed in the same manner as third leg 50 of bookmarker 10. The third leg 126 extends toward the back of the book at an angle $\beta$ in the range of 0° to 15° (See FIG. 12) preferably in the range of 0 to 10. In the particular embodiment illustrated, the third leg is extending at an angle of 10°.

The operation and use of the bookmarker 110 is the same as bookmarker 10 and thus does not need to be described any further.

Referring to FIGS. 13 through 23, there is illustrated various modified forms of a bookmarker made in accordance with the present invention. In these embodiments, instead of using a metal clip as illustrated in FIGS. 1 through 8 ,the spring is secured to the book by the use of an adhesive tape. In these embodiments, identical numerals as illustrated in FIGS. 1 through 8 indicate like parts.

Figure 13:
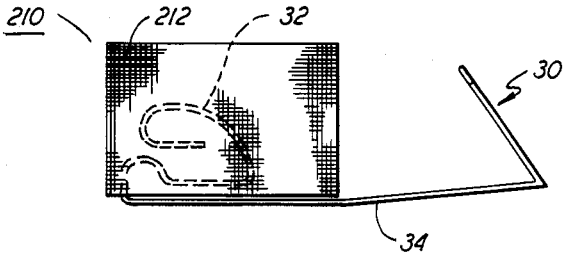
FIG. 13 is a front elevational view of yet another modified form of a bookmarker made in accordance with the present invention.
Figure 14:
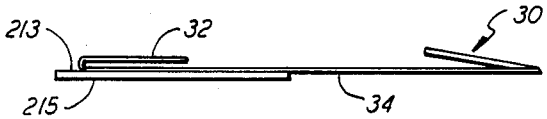
FIG. 14 is a top plan view of FIG. 13.

Referring to FIGS. 13–14, there is illustrated a bookmarker 210 having a spring 30. The spring 30 has a mounting leg section 32, and a marking leg section 34. The mounting leg section 32 is securely mounted to the book by means of a piece or strip of adhesive tape 212. The back side 213 of tape 212 has an adhesive surface capable of being secured to the back portion of a book. The front side 215 is a non adhesive surface. The mounting leg 32 is configured such that tape 212 securely holds the mounting leg section 32 to the book, especially during turning of the pages of the book. The marking leg section 34 is constructed much in the same manner as the marking leg 34 of FIG. 1–8 and also operates in substantially the same manner. The principle difference resides in the manner in which the spring is securely held in position. In the embodiment illustrated in FIGS. 1–8 mounting leg 32 is held in position by a slot and opening in the clip whereas in the embodiment of FIG. 13 the mounting leg 32 is securely held to the back portion of the book by an adhesive tape.

Figure 15:
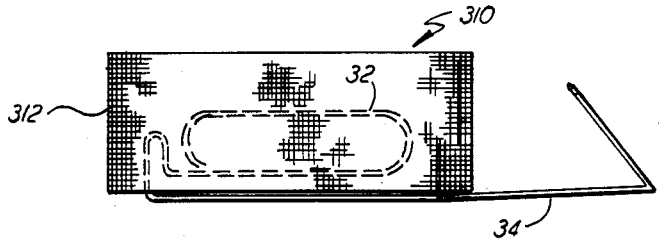
FIG. 15 is a front elevational view of still another modified form of a bookmarker made in accordance with the present invention.

Referring to FIG. 15, there is illustrated a front elevational view of still another modified form of a bookmarker made in accordance with the present invention. The bookmarker 310 is similar to the bookmarker 210 of FIGS. 13–14 except that the mounting leg 32 has a different configuration. In this embodiment, the mounting leg 32 has a configuration somewhat similar to a paper clip.

Figure 16:
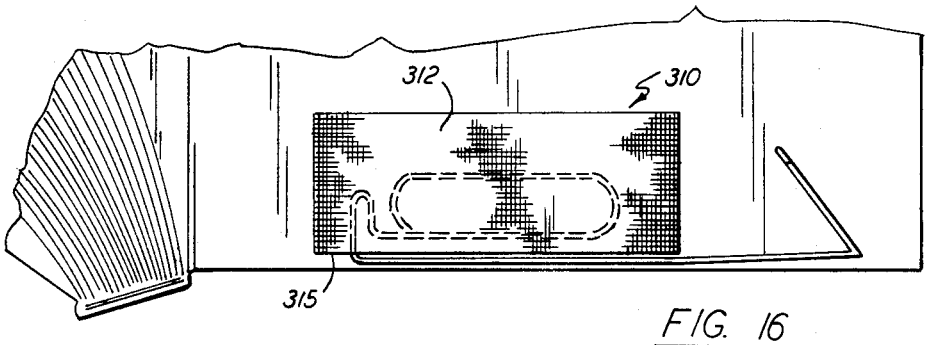
FIG. 16 is a perspective view of the bookmarker of FIG. 15 mounted to a book.

Referring to FIG. 16, there is illustrated bookmarker 310 is mounted to the back portion of the book. The tape 312 is secured the back of the book by any typical type adhesive placed on the back of the tape as is customary in prior art. The adhesive applied should have strength sufficient to withstand the forces that may be applied to the marking leg 34 as the pages are turned. A particular advantage of this type of embodiment wherein a tape is used to securely hold the mounting leg to the back of the book is that it may be applied by the publisher and/or applied by the user and thereafter becomes a permanent part of the book.

Figure 17:
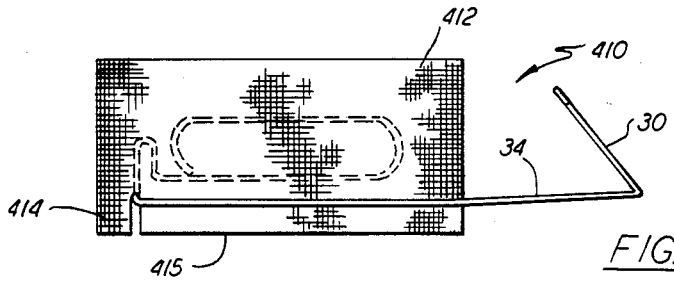
FIG. 17 is a front elevational view of yet another modified form of a bookmarker made in accordance with the present invention.

As is illustrated in FIGS. 13–15, the marking leg extends below the bottom edge 315 of the tape. However, the present invention is not so limited. Referring to FIG. 17, there is illustrated yet another modified form of the present invention wherein a bookmarker 410 having a tape 412 is to hold spring 30. In this particular embodiment, a slot 414 is provided in tape 412 such that the marking leg 34 is above the bottom edge 415 of the tape 412. An advantage this embodiment provides is its ability to withstand greater forces on the spring as the pages are turned.

Figure 18:
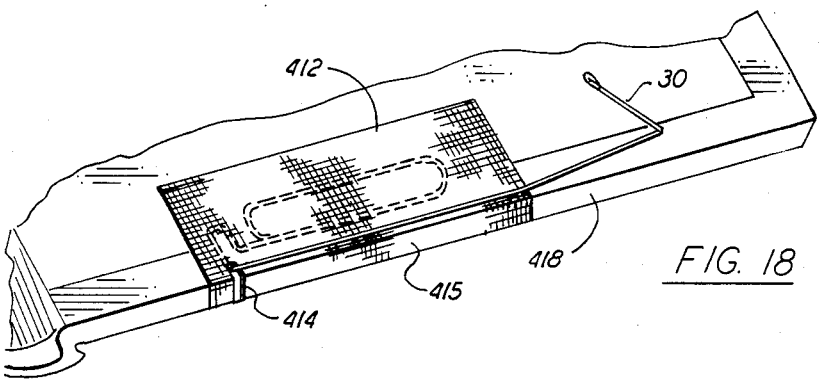
FIG. 18 is a perspective view of the bookmarker of FIG. 17 mounted to a book.

Referring to FIG. 18 the bookmarker 410 is illustrated mounted to the back of the book. As can be seen, bottom edge 415 of the tape 412 is wrapped around the bottom edge 418 of the book.

Figure 19:
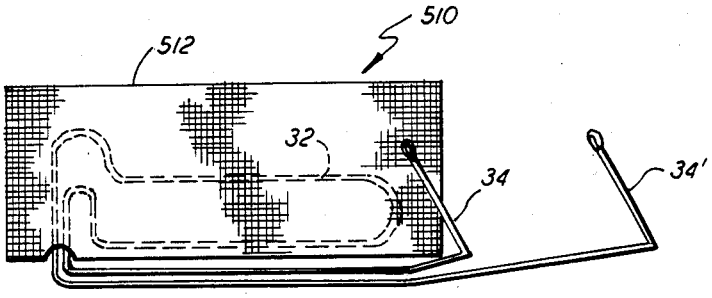
FIG. 19 is front elevational view of another modified form of the bookmarker named in accordance with the present invention.
Figure 20:
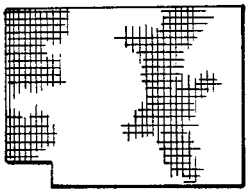
FIGS. 20–23 illustrate various shapes of the tape portion of the bookmarker made in accordance with the present invention.
Figure 21:
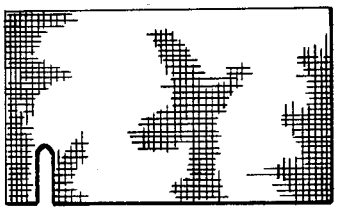
Figure 22:
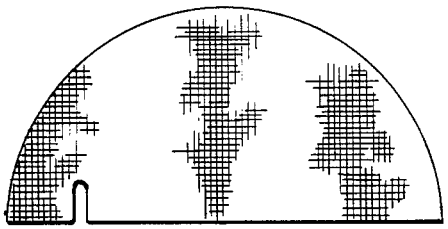
Figure 23:
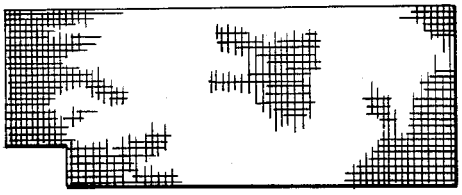

Referring to FIG. 19, there is illustrated yet another modified form of the present invention. In this particular embodiment, a bookmarker 510 comprises a tape 512 used to secure the mounting leg 34 of spring 30. However, in this particular embodiment, instead of having a single marking leg 34, there is provided two marking legs 34 and 34'. This is accomplished by having the free end of mounting leg 32, which is normally left underneath the tape, extend out from behind the tape as illustrated. In this particular embodiment, the difference between the marking legs 34 and 34' is that one will have a greater length than the other. In this manner, more than one place may be maintained in the book by the reader. Therefore, if the person wishes one marking leg 34 may be placed, for example, further back in the book and the other marking leg 34' may be placed in the front of the book. Preferably the shorter leg is used for the back of the book. In this particular embodiment, it can be seen that the marking leg 34' is preferably disposed below the marking leg 34 so as not to interfere with the turning of the pages. The mounting leg 32 here again has a shape somewhat of a paper clip. However, it is to be understood that the mounting leg may take a variety of other shapes and configurations as previously illustrated and of those which have not been illustrated. This embodiment can quite useful for use with large books. The longer marking leg can be used for the front of the book and the shorter marking leg can be used for the back portion of the book.

Referring to FIGS. 20–23 there is illustrated various other configurations of the tape portion of the bookmarker may take. It is only sufficient that the tape portion provide a sufficient amount of force to hold the mounting leg to the book such that it does not loosen significantly over time. It is, of course, understood that various other configurations not illustrated may be used as desired such as a butterfly shape.

In the embodiments illustrated in FIGS. 13–23, an adhesive tape is used to secure the spring 30 to the book, however, the present invention is not so limited. For example, the spring may be permanently affixed to the book by having the mounting leg permanently embedded in the cover, by being bound into the lock or by being permanently held between the cover and a cover sheet secured to the cover. Alternatively, the mounting leg may be mounted between two pieces of tape wherein the tape is secured to the book in any manner desired. Further, the mounting leg 32 of spring 30 may be embedded in a stiff base support, for example, a thin sheet of plastic. The piece of plastic material can then be secured to the book by an appropriate adhesive or the securing means such as a staple. It is, of course, understood that more than one spring 30 may be secured to the book as desired. Additionally, the adhesive may be initially provided on the tape or applied later. The spring 30 in the embodiments illustrated in FIGS. 13–27 is preferably made of a spring metal, however, the present invention is not so limited. The spring 30 may be made of other material capable of providing the desired spring force, for example, a plastic material.

It is to be understood that various other changes or modifications may be made without departing from the scope of the present invention. For example, but not by way of limitation, the shape of the clip portion may be made in any desired shape, the cross sectional shape and size of the retaining spring may be varied, and type of plastic material may be used for the plastic bookmarker as desired.

We claim:

1. A bookmarker for use with a book comprising:

a clip portion for firmly attaching said bookmarker to the back portion of a book, said clip portion having a generally U shape configuration, said clip portion having an upwardly extending back section and an upwardly extending front section connected by a bottom section, said clip being configured so as to be capable of firmly clamping a portion of the book therebetween, said bottom section having an axial slot at one edge and an opening spaced from said slot;

a retaining spring for marking a place in said book, said retaining spring having a mounting leg and a marking leg, said mounting leg having a hook portion at its terminal end for placement within said opening in said bottom section of said clip portion and a retaining loop section for placement in said slot for retaining said spring securely to said clip portion, said marking leg being spaced away from and substantially parallel to said mounting leg so as not to interfere with said mounting leg when pages of said book are turned, said marking leg comprising a first horizontal leg extending from said slot axially along the length of said bottom section, a second intermediate section which extends at an angle with respect to the horizontal plane of said first horizontal leg and a third vertical section which extends vertically upwardly into said book for placement against the pages of said book, said third vertical section having a terminal end which extends up into said book a distance of at least $\frac{3}{8}$ inch from the bottom of the page.

2. A bookmarker according to claim 1 wherein said terminal end extends up into said book a distance from the bottom of the page of about $\frac{3}{4}$ inch.

3. A bookmarker according to claim 1 wherein said second intermediate section extends at an angle in the range of 0°–10°.

4. A bookmarker according to claim 4 wherein said second intermediate section extends at an angle of about 2.5°.

5. A bookmarker according to claim 1 said third vertical section extends at an angle with respect to a horizontal plane in the range of 15°–60°.

6. A bookmarker according to claim 5 wherein said third vertical section extends at an angle in the range of about 25°–45°.

7. A bookmarker according to claim 6 wherein said third vertical section extends at an angle of about 25°.

* * * * *